US006082027A

United States Patent [19]

Wagonhurst

[11] Patent Number: 6,082,027

[45] **Date of Patent: *Jul. 4, 2000**

[54] SIZE-ADJUSTABLE FOOTWEAR

[75] Inventor: Peter A. Wagonhurst, Montecito, Calif.

[73] Assignee: Variflex, Inc., Moorpark, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/074,294

[22] Filed: May 7, 1998

[51] Int. Cl.[7] ..... A43B 3/26; A43B 19/00; A43B 7/26; A43B 5/04; A43C 13/14

[52] U.S. Cl. ..... 36/97; 36/117.6; 36/71; 36/94; 36/77 R

[58] Field of Search ..... 36/117.1, 117.6, 36/115, 55, 71, 93, 94, 95, 96, 97, 10, 100, 101, 77 R, 72 R, 113

[56] References Cited

U.S. PATENT DOCUMENTS

| | | | |
|---|---|---|---|
| 4,055,858 | 11/1977 | Traenkle | 36/10 |
| 4,106,126 | 8/1978 | Traenkle | 36/10 |
| 4,805,321 | 2/1989 | Tonkel | 36/100 |
| 5,050,319 | 9/1991 | Perotto et al. | 36/117.1 |
| 5,065,531 | 11/1991 | Prestridge | 36/100 |
| 5,397,141 | 3/1995 | Hoshizaki et al. | 36/115 |
| 5,566,475 | 10/1996 | Donnadieu | 36/55 |
| 5,592,758 | 1/1997 | Iwama et al. | 36/117.1 |
| 5,738,937 | 4/1998 | Baychar | 36/44 |
| 5,761,830 | 6/1998 | Condini | 36/10 |
| 5,768,807 | 6/1998 | Caeran et al. | 36/115 |
| 5,772,220 | 6/1998 | Gaster | 36/115 |
| 5,791,069 | 8/1998 | Oradesky | 36/77 R |

*Primary Examiner*—Paul T. Sewell
*Assistant Examiner*—Anthony Stashick
*Attorney, Agent, or Firm*—Oppenheimer Wolff & Donnelly LLP

[57] ABSTRACT

Size-adjustable footwear includes an outer shell and a liner disposed within the shell. The liner has an upper, a heel, and a toe. An insert is releasably receivable within the toe of the liner. The liner has a first size which is defined between the heel and the insert when the insert is received within the toe, and a second size which is defined between the heel and the toe when the insert is not received within the toe. The first size is less than the second size. A user may select footwear based on the smaller first size, and then as his or her feet grow, remove the insert to accommodate the larger feet.

21 Claims, 2 Drawing Sheets

SIZE-ADJUSTABLE FOOTWEAR

BACKGROUND OF THE INVENTION

1. Field of the Invention

The present invention relates to footwear, particularly athletic footwear. The present invention also relates to skates such as in-line, roller, and ice skates. The footwear of the present invention is able to be adjusted in size to accommodate differently sized feet.

2. Description of the Related Art

The popularity of athletics has risen dramatically during the last generation. More and more people are participating in sports, especially sports which require specialized footwear such as in-line skating (both recreational and hockey), ice skating, skiing, and so on. The expense of participating in such sports is often directly proportional to the cost of purchasing the required specialized footwear. As the cost of the footwear is expensive, the cost of participation is accordingly expensive.

The cost of having children participate in these sports is particularly high because children's feet grow at such a fast pace that footwear needs to be continually replaced. One approach at overcoming the high expense of having children participate in sports is to purchase inexpensive footwear. However, inexpensive footwear is typically of low quality and, therefore, does not perform at the higher standards of better equipment. In addition, inexpensive footwear may be ill fitting and, thus, may result in injury.

Another approach has been to develop in-line skates which are expandable. In-line skates have a protective outer shell and a sole to which the wheel assembly is attached. Expandable skates have a slot and a nut which, when loosened, allows the user to adjust the size of the shell and the sole. This approach has a drawback in that the expandable skates are complicated and, accordingly, expensive. In addition, consumers may question the integrity and safety of a skate that pulls apart and expands. Also, although the outer shell is expandable, the inner sock or liner in which a foot is received is not adjustable and needs replacing, which is expensive as well.

Another approach at overcoming the high cost of purchasing specialized athletic footwear is to rent the footwear. For example, in many beach communities, for example, there are in-line skating rentals where a person may rent the skates on an hourly or daily basis. Also, many people rent ski equipment. One of the drawbacks of renting specialized athletic footwear is that often times the correctly sized footwear is not available. The renter then, out of necessity, rents footwear which does not fit properly. This is typically footwear of a larger size. As known, wearing improperly sized footwear is both uncomfortable and unsafe, particularly when participating in sports.

BRIEF SUMMARY OF THE INVENTION

In view of the foregoing drawbacks of conventional skates, one of the objectives of the present invention is to provide footwear which is size adjustable. Accordingly, as a child's feet grow, the size of the footwear may be increased to accommodate the increased size (both length and width) of the child's feet, thereby allowing the child to continue wearing the same footwear for a longer period of time. Alternatively, people having differently sized feet may adjust the size of the footwear to fit their respective feet.

According to one aspect of the invention, size-adjustable footwear includes an outer shell and a liner disposed within the shell. The liner has an upper, a heel, and a toe. An insert is releasably receivable within the toe of the liner. The liner accordingly has a first size which is defined between the heel and the insert when the insert is received within the toe, and a second size which is defined between the heel and the toe when the insert is not received within the toe. The first size is less than the second size.

In an exemplary use, the skates are selected for a child based on the first size to fit the current size of the child's feet, such as size 3. After the child's feet have grown a certain amount, the insert is removed to accommodate the larger feet. For example, with the insert removed, the liner may accommodate a size-5 foot. Accordingly, rather than replacing the skates after the child's feet have outgrown the skates, the insert is removed so that the child may continue wearing and using the same skates for a longer period of time.

According to another aspect of the invention, the insert may be made from a resilient material, such as foam rubber. This resilient insert accordingly provides cushioning for the user's toes. In addition, the insert can compress as the feet grow to maintain a well-fitting skate prior to removing the insert. This feature allows the skates to be configured over a longer range of sizes (between the smaller first size and the larger second size).

Another aspect of the present invention involves the provision of fastening material for releasably fastening the insert within the toe. The insert may include a layer of fastening material, and the liner may include a layer of complementary fastening material which releasably engages with the fastening material of the insert. For example, the fastening material may be hook-and-loop fasteners. The fastening material securely maintains the insert in a desired position within the toe area of the liner. This is particularly advantageous as many uses of the footwear may involve highly athletic activities such as skating and skiing. In addition, the insert may be removed from and re-inserted into the toe of the liner as desired. This is particularly advantageous in equipment rental applications.

According to another aspect of the invention, the insert is configured to complement the shape of the toe of the liner. For example, the insert may have a substantially arcuate upper side which conforms to the vamp of the toe, and a substantially flat lower side which conforms to the sole of the liner. This complementary configuration of the insert allows the insert to fit securely and comfortably within the toe of the liner.

The size-adjustable footwear of the present invention may be applied for many uses, such as in-line skates, ice skates, ski boots, and so on. Accordingly, the sole of the shell may be adapted to mount to a locomotive assembly, such as an in-line wheel assembly or an ice-blade assembly. Alternatively, the sole of the shell may be configured to engage with a ski binding, either of an alpine ski or a cross-country ski.

Other objects, features, and advantages of the present invention will become apparent to those skilled in the art from a consideration of the following detailed description taken in conjunction with the accompanying drawings which illustrate, by way of example, the principles of the present invention in the context of an in-line skate, but which are equally relevant to other types of footwear, particularly specialized athletic footwear.

DETAILED DESCRIPTION OF THE INVENTION

Figure 1:
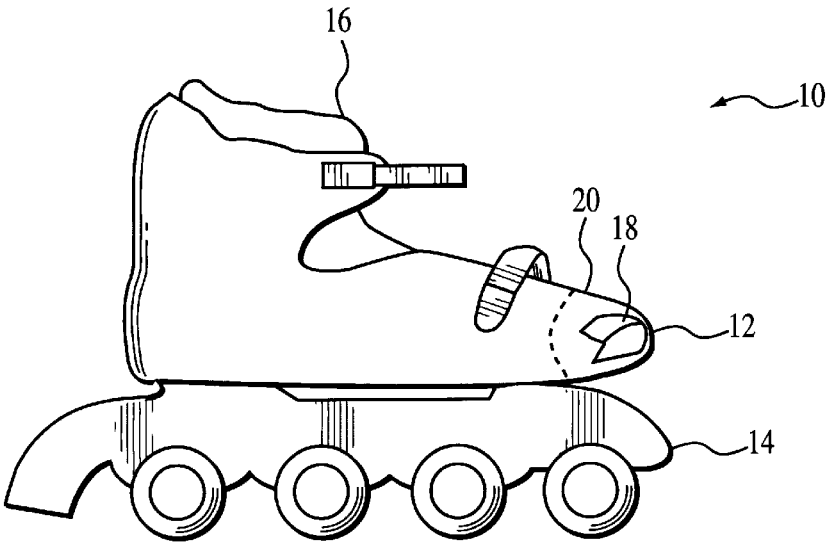
FIG. 1 is a cut-away perspective view of an exemplary in-line skate configured in accordance with the present invention, particularly illustrating an insert received within a liner of the skate.

Referring more particularly to the drawings, an exemplary size-adjustable skate 10 configured in accordance with the teachings of the present invention is illustrated in FIG. 1. For purposes of explanation and without limiting the scope of the present invention, exemplary skate 10 is illustrated as an in-line skate. However, the teachings of the present invention may be readily applied to other footwear specialized for particularly sports, such as ice skates (both figure and hockey), ski boots, swim fins, and so on.

Exemplary skate 10 includes an outer shell 12 mounted to a locomotive assembly, for example, an in-line wheel assembly 14. An inner liner 16 is disposed within shell 12, preferably in a removable manner. At least one resilient insert 18 is releasably attachable within the liner 16 so that the size can be adjusted, which will be discussed in more detail below.

Figure 3:
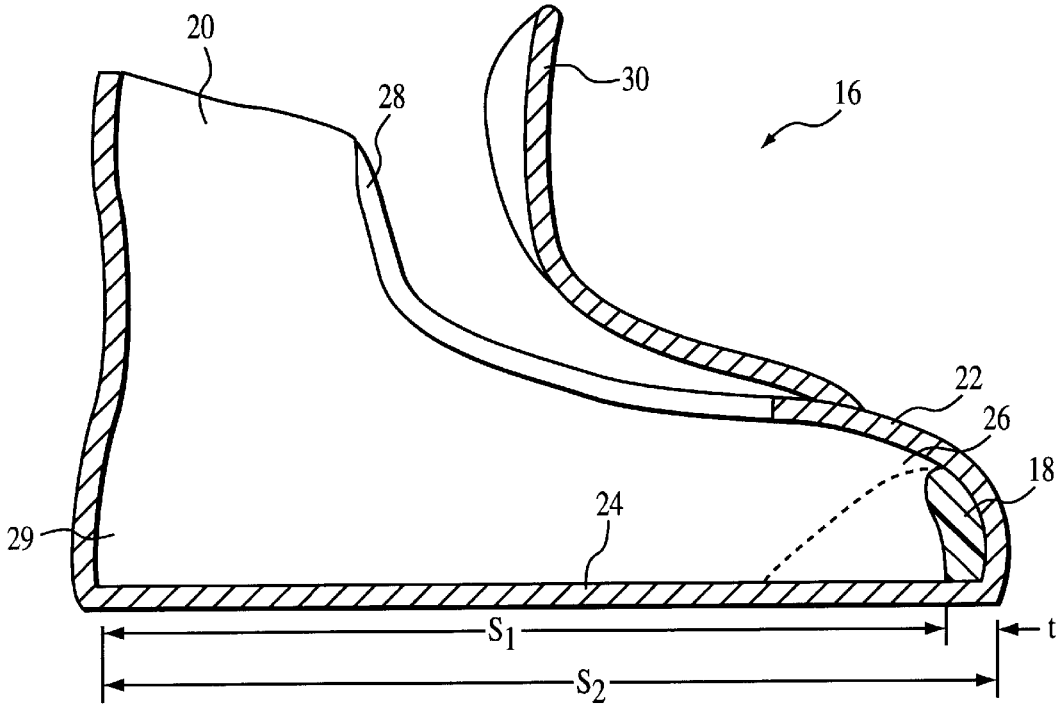
FIG. 3 a cross-sectional view of the liner taken along line 3—3 of FIG. 2.
Figure 2:
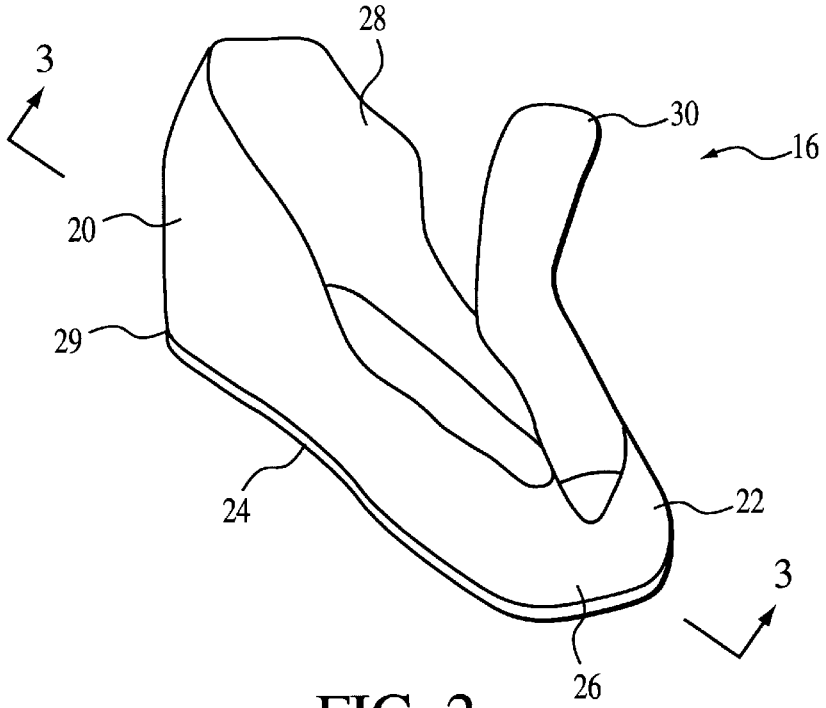
FIG. 2 is a perspective view of an exemplary liner of the invention.

Referencing FIGS. 2 and 3, exemplary liner 16 includes an upper 20 with a vamp 22, a sole 24, a toe 26 generally defined within the vamp 22, and a heel 29. The upper 20 includes an opening 28 extending rearward from the vamp 22 and a tongue 30 pivotally attached to the vamp for covering the opening 28. Exemplary insert 18 is illustrated in phantom line in FIG. 3 to indicate the insert may be either positioned within the toe 26 of the liner 16 or removed from the liner altogether. Accordingly, the size of the liner 16 is adjustable among a plurality of predetermined sizes depending upon whether the insert 18 is received within the liner or not.

For example, in a commercially preferred embodiment of the invention as illustrated in FIG. 3, the liner 16 is adjustable between two predetermined sizes: a first size $S_1$ defined between the most rearward portion of the heel 29 and the insert 18 and a second size $S_2$ defined between the most rearward portion of the heel 29 and the most forward portion of the toe 26. First size $S_1$ is smaller than second size $S_2$ by an amount substantially equal to a thickness t of the insert 18. Accordingly, a child whose foot is approximately size $S_1$ may use the skate 10 with the insert 18 received within the toe 26 of the liner 16. As the child's feet grow to a size larger than size $S_1$ and approach size $S_2$, then the insert 18 may be removed from the toe 26 so that the child may continue to comfortably wear the skate 10. For example, first size $S_1$ may be about a size 3, and second size $S_2$ may be about a size 5. With conventional nonadjustable skates, the skates would need to be replaced when outgrown, which is expensive and wasteful.

Figure 4:
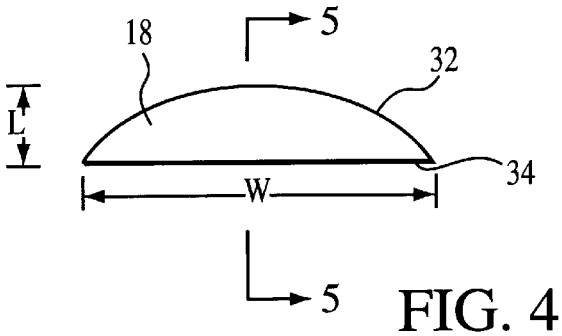
FIG. 4 is a plan view of an exemplary insert of the present invention.
Figure 5A:
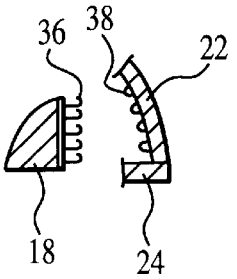
FIG. 5A is a cross-sectional view of the insert taken along line 5—5 of FIG. 4.

With additional reference to FIGS. 4 and 5, exemplary insert 18 may have a configuration complementary to that of the toe 26 of the liner 16 so as a secure fit is made between the two elements. As shown in FIG. 4, the insert 18 of the invention may have a substantially arcuate top surface 32 for conforming to the toe 26 of the liner 16 and a substantially planar bottom surface 34 for conforming to the sole 24 of the liner. Although their respective conforming configurations may securely retain the insert 18 within the toe 26 of the liner 16, releasable fastening means may be provided to provide a secure engagement between the insert and the liner, for example, complementary hook-and-eye fastening means (such as Velcro®). Accordingly, as shown in FIG. 5A, exemplary insert 18 may include a layer of hook material 36, and exemplary liner 16 may include a layer of complementary eye material 38. Alternatively, rather than providing the dedicated layer of eye material 38, the liner 16 may be made from a fibrous material to which the layer of hook material 36 is readily engagable.

Figure 5B:
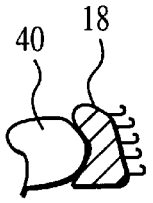
FIG. 5B is an alternative cross-sectional view of the insert taken along line 5—5 of FIG. 4, particularly illustrating a compressive property of the insert.

Referencing FIG. 5B, exemplary insert 18 is made from a substantially resilient material such as foam rubber. In addition to providing cushioning for a user's toes 40, the resilient material of the insert 18 is able to compress between the first size $S_1$ and the second size $S_2$ as the user's feet grow between these two predetermined sizes. Accordingly, a greater difference between the two predetermined sizes may be provided than if the insert 18 were not resilient and compressible. More specifically, if the insert 18 were not compressible, then, for example, size $S_1$ may be a size 3 and size $S_2$ may be a size 4; however, if the insert 18 is compressible in accordance with the present invention, then, for example, size $S_1$ may be a size 3 and size $S_2$ may be a size 5. The greater the difference between the two sizes $S_1$ and $S_2$, the longer the child athlete may use the skate 10.

In addition to be compressible, the resilient insert 18 may also be flexible or bendable to more readily conform to the configuration of the toe 26 of the liner 16. As shown in FIG. 4, exemplary insert 18 has a width w which is preferably greater than the width of the toe 26. The insert 18 may wrap within the toe 26 and partially extend rearward down the sides of the liner 16, as shown in FIGS. 1 and 3. Accordingly, the insert 18 accommodates not only for the length of a foot but also for the width of the toes of a foot.

With further reference to FIG. 3, in order to provide easy access to the insert 18 for insertion and removal, the opening 28 in the upper 20 of the liner 16 preferably extends forward a substantial length of the liner. Accordingly, a user may pivot the tongue 30 away from the opening 28 and insert his or her hand through the opening 28 to gain access to the insert 18 for removal and/or insertion. For example, the portion of the vamp 22 extending from the opening 28 to the received insert 18 may be on the order of a couple inches so that fingers may easily grasp the insert.

In addition to adjusting to the increasing size of a child's feet, the insert 18 may be utilized in rental applications to render a correctly fitting skate for multiple users. Many equipment rentals carry a set number of footwear for each size, for example, in-line skates, ice skates, ski boot, swim fins, and so on. Many times a renter of such footwear has to settle on ill fitting larger sized footwear. However, if the rental footwear were configured in accordance with the present invention, then an insert may be selected from a plurality of differently sized insert which provides a proper fit for the renter of the footwear.

In this regard, rather than providing a single insert 18 with a pair of skates 10 of the present invention, each skate may be provided with a set consisting of a plurality of inserts 18. For example, each insert of the set may have a different thickness, so that the insert with the greatest thickness may be received within the toe 26 of the liner 16. As the child's feet grow, inserts of decreasing thickness may be received within the liner 16 until no insert is received within the toe. Alternatively, each insert of the set may have substantially the same thickness, but a plurality of inserts may be received within the toe 26 of the liner 16 at one time. As the child's feet grow, one insert at a time may be removed, thereby decreasing the collective thickness of the inserts, until no insert is received within the toe.

Generally speaking with regard to the plurality of predetermined sizes $S_1$ and $S_2$ (and $S_N$), the skate 10 and, more particularly, the liner 16 may be configured to have any predetermined overall length as exemplified by size $S_2$ in FIG. 3. Exemplary insert 18 may then be configured to have any predetermined thickness t to yield a desired shorter length as exemplified by size $S_1$ in FIG. 3. In a specific commercial embodiment of the skate 10 designed for children, the liner 18 may have a width w ranging from about 3 inches to about 5 inches, a thickness t ranging from about 0.2 inch to about 0.8 inch, and a height h ranging from about 0.5 inch to about 1.5 inches. The dimensions of the liner 16 may be configured in accordance with that which is known in the art.

As mentioned above, exemplary skate 10 is illustrated and described herein as an in-line skate including a wheel assembly 14. Numerous alternative embodiments of the skate 10 are also within the scope of the invention. For example, rather than attaching shell 12 to an in-line wheel assembly 14, the shell 12 may be mounted to a blade assembly for ice skating. In addition, exemplary skate 10 may include the shell 12 and the inner liner 16 only, and may not be provided with any locomotion assembly. For example, exemplary shell 12 may be configured as a ski boot which engages with bindings, for both alpine skiing and cross-country skiing. In addition, the principles of size-adjustable linings may also be applied to swim fins and other athletic footwear.

Those skilled in the art will understand that the preceding exemplary embodiments of the present invention provide the foundation for numerous alternatives and modifications thereto. These other modifications are also within the scope of the present invention. Accordingly, the present invention is not limited to that precisely as shown and described herein.

What is claimed is:

1. Size-adjustable footwear comprising:

a shell having a sole and an upper;

a liner disposed within said shell and including an upper, a heel, and a toe;

said toe having a first side portion and a second side portion; and an insert receivable within said toe of said liner, said insert having a front portion, a first side portion, and a second side portion, said insert being releasably attachable within said liner and having a width w which is greater than the width of said toe of said liner such that said first and second side portion of said insert wraps within said toe of said liner and partially extends rearward down the first and second side portion of said liner to accommodate for the length of a wearer's foot and for the width of the toes of the wearer's foot;

said liner having a first size defined between said heel and said insert and between said first side portion of said insert and said second side portion of said insert when said insert is received within said toe and a second size defined between said heel and said toe and between said first side portion of said toe and said second side portion of said toe when said insert is not received within said toe, said first size being less than said second size; and said front portion of said insert following a natural curve of a wearer's frontal toe line, said first side portion of said insert and said second side portion of said insert extending along a side of the wearer's foot.

2. Size-adjustable footwear as claimed in claim 1 wherein said insert comprises resilient material.

3. Size-adjustable footwear as claimed in claim 2 wherein said resilient material comprises foam rubber.

4. Size-adjustable footwear as claimed in claim 1 wherein:

said insert comprises a layer of fastening material; and said liner comprises a layer of complementary fastening material for releasably engaging with said fastening material of said insert.

5. Size-adjustable footwear as claimed in claim 4 wherein said fastening material comprises hook-and-loop fasteners.

6. Size-adjustable footwear as claimed in claim 1 wherein said insert is configured to complement the shape of said toe of said liner.

7. Size-adjustable footwear as claimed in claim 6 wherein said insert includes a substantially arcuate upper side and a substantially flat lower side.

8. Size-adjustable footwear as claimed in claim 1 wherein said upper of said liner includes:

a vamp;

an opening extending rearward from said vamp; and a tongue attached to said vamp for covering said opening;

said vamp and said opening being configured so that said toe is readily accessible through said opening.

9. Size-adjustable footwear as claimed in claim 1 further comprising an outer protective shell.

10. Size-adjustable footwear as claimed in claim 9 wherein said liner is removably disposed within said shell.

11. Size-adjustable footwear as claimed in claim 9 wherein said shell includes a sole adapted to mount to a locomotive assembly.

12. Size-adjustable footwear as claimed in claim 11 wherein said locomotive assembly comprises an in-line wheel assembly.

13. A method for adjusting the size of footwear, comprising the steps of:

providing footwear including:

a shell having a sole and an upper;

a liner disposed within said shell and having an upper, a heel, and a toe;

said toe having a first side portion and a second side portion; and an insert releasably received within said toe of said liner, said insert having a front portion, a first side portion, and a second side portion, said insert being releasably attachable within said liner and having a width w which is greater than the width of said toe of said liner such that said first and second side portion of said insert wraps within said toe of said liner and partially extends rearward down the first and second side portion of said liner to accommodate for the length of a wearer's foot and for the width of the toes of the wearer's foot;

said liner having a first size defined between said heel and said insert and between said first side portion of said insert and said second side portion of said insert when said insert is received within said toe and a second size defined between said heel and said toe and between said first side portion of said toe and said second side portion of said toe when said insert is not received within said toe, said first size being less than said second size;

said front portion of said insert following a natural curve of a wearer's frontal toe line, said second side portion of said insert extending along a side of the wearer's foot; and removing said insert from said liner.

14. A method as claimed in claim 13 further comprising the step of positioning said insert within said toe of said liner.

15. A method as claimed in claim 13 further comprising the step of:

providing said liner with a vamp;

extending an opening rearward from said vamp; and configuring said vamp and said opening so that said toe is readily accessible through said opening.

16. A method as claimed in claim 13 further comprising the step of:

providing a sole adapted to mount to a locomotive assembly.

17. A method as claimed in claim 16 wherein said locomotive assembly comprises an in-line wheel assembly.

18. A method as claimed in claim 13 wherein said insert comprises resilient material.

19. A method as claimed in claim 18 wherein said resilient material comprises foam rubber.

20. A method as claimed in claim 13 wherein:

said insert comprises a layer of fastening material; and said liner comprises a layer of complementary fastening material for releasably engaging with said fastening material of said insert.

21. A method as claimed in claim 20 wherein said fastening material comprises hook-and-loop fasteners.

* * * * *